US009375128B2

(12) United States Patent
Feddema et al.

(10) Patent No.: US 9,375,128 B2
(45) Date of Patent: Jun. 28, 2016

(54) DISHWASHER WITH SPRAY SYSTEM

(75) Inventors: Mark S. Feddema, Kalamazoo, MI (US); Chad T. Vanderroest, Covert, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 777 days.

(21) Appl. No.: 13/570,543

(22) Filed: Aug. 9, 2012

(65) Prior Publication Data

US 2013/0074886 A1 Mar. 28, 2013

Related U.S. Application Data

(60) Provisional application No. 61/537,595, filed on Sep. 22, 2011.

(51) Int. Cl.
*A47L 15/42* (2006.01)
*A47L 15/23* (2006.01)

(52) U.S. Cl.
CPC ..... *A47L 15/23* (2013.01); *A47L 15/4282* (2013.01)

(58) Field of Classification Search
CPC ..... A47L 15/4282
See application file for complete search history.

(56) References Cited

U.S. PATENT DOCUMENTS

| | | | |
|---|---|---|---|
| 3,064,664 | A | 11/1962 | Warhus |
| 3,146,953 | A | 9/1964 | Komanns |
| 3,253,784 | A | 5/1966 | Long et al. |
| 3,709,236 | A | 1/1973 | Field et al. |
| 3,771,725 | A | 11/1973 | Jenkins et al. |
| 3,797,509 | A | 3/1974 | Fukuzawa et al. |
| 3,918,644 | A | 11/1975 | Platt et al. |
| 4,266,565 | A | 5/1981 | Gurubatham |
| 4,509,687 | A | 4/1985 | Cushing |
| 4,993,444 | A | 2/1991 | Toriyama et al. |
| 5,331,986 | A | 7/1994 | Lim et al. |
| 5,415,350 | A | 5/1995 | Yoon et al. |
| 5,427,129 | A | 6/1995 | Young, Jr. et al. |
| 2,726,666 | A | 12/1995 | Oxford |
| 5,546,968 | A | 8/1996 | Jeon et al. |
| 5,577,665 | A | 11/1996 | Chang |
| 5,601,100 | A | 2/1997 | Kawakami et al. |
| 5,609,174 | A | 3/1997 | Ferguson |
| 5,655,556 | A | 8/1997 | Guerrera et al. |
| 5,662,744 | A | 9/1997 | Tuller et al. |

(Continued)

FOREIGN PATENT DOCUMENTS

| | | | |
|---|---|---|---|
| DE | 7024995 | U | 6/1970 |
| DE | 4036930 | A1 | 5/1992 |

(Continued)

OTHER PUBLICATIONS

European Search Report for Corresponding EP 12185514.2, Dec. 6, 2012.

(Continued)

*Primary Examiner* — Jason Ko

(57) ABSTRACT

A dishwasher includes a tub at least partially defining a treating chamber for receiving utensils for treatment according to the automatic cycle of operation, a rotatable spray arm provided within the treating chamber and defining an interior through which liquid may pass, and hydraulic driving nozzles to rotate the rotatable spray arm in both a a first direction and a second direction, opposite the first direction.

16 Claims, 6 Drawing Sheets

(56) References Cited

U.S. PATENT DOCUMENTS

| | | | |
|---|---|---|---|
| 5,673,714 | A | 10/1997 | Campagnolo et al. |
| 5,697,392 | A | 12/1997 | Johnson et al. |
| 5,944,037 | A | 8/1999 | Sinyong et al. |
| 5,964,232 | A | 10/1999 | Chung |
| 6,053,185 | A | 4/2000 | Beevers |
| 6,325,083 | B1 | 12/2001 | Worter |
| 7,314,188 | B2 | 1/2008 | Watson et al. |
| 7,331,356 | B2 | 2/2008 | VanderRoest et al. |
| 7,445,013 | B2 | 11/2008 | VanderRoest et al. |
| 7,475,696 | B2 | 1/2009 | Vanderroest et al. |
| 7,493,907 | B2 | 2/2009 | Roh |
| 7,523,758 | B2 | 4/2009 | Vanderroest et al. |
| 7,594,513 | B2 | 9/2009 | VanderRoest et al. |
| 7,673,639 | B2 | 3/2010 | Shin |
| 7,810,512 | B2 | 10/2010 | Pyo et al. |
| 7,896,977 | B2 | 3/2011 | Gillum et al. |
| 7,935,194 | B2 | 5/2011 | Rolek |
| 7,959,744 | B2 | 6/2011 | Sundaram et al. |
| 7,980,260 | B2 | 7/2011 | Bertsch et al. |
| 8,113,222 | B2 | 2/2012 | Bertsch et al. |
| 8,137,479 | B2 | 3/2012 | Vanderroest et al. |
| 8,187,390 | B2 | 5/2012 | Vanderroest et al. |
| 8,210,191 | B2 | 7/2012 | Gnadinger et al. |
| 8,282,741 | B2 | 10/2012 | Bertsch et al. |
| 2006/0278258 | A1 | 12/2006 | Kara et al. |
| 2007/0056613 | A1 | 3/2007 | Haas et al. |
| 2007/0289615 | A1 | 12/2007 | Shin |
| 2009/0101182 | A1 | 4/2009 | Buesing et al. |
| 2009/0101185 | A1 | 4/2009 | Pardini |
| 2009/0159103 | A1 | 6/2009 | Gillum et al. |
| 2010/0139719 | A1 | 6/2010 | Gnadinger et al. |
| 2011/0030742 | A1 | 2/2011 | Dalsing et al. |
| 2011/0203619 | A1 | 8/2011 | Kara et al. |
| 2011/0303250 | A1 | 12/2011 | Delgado et al. |
| 2012/0279530 | A1 | 11/2012 | Thiyagarajan |
| 2012/0279536 | A1 | 11/2012 | Adams et al. |
| 2013/0074886 | A1 | 3/2013 | Feddema et al. |
| 2013/0074888 | A1 | 3/2013 | Feddema |
| 2013/0074890 | A1 | 3/2013 | Feddema et al. |
| 2014/0054395 | A1 | 2/2014 | Heisele et al. |
| 2014/0332041 | A1 | 11/2014 | Feddema |

FOREIGN PATENT DOCUMENTS

| | | | |
|---|---|---|---|
| DE | 102005026558 | B3 | 11/2006 |
| DE | 102010043019 | A1 | 5/2012 |
| DE | 102011053666 | A1 | 5/2012 |
| EP | 0524102 | A1 | 1/1993 |
| EP | 0764421 | A1 | 3/1997 |
| EP | 0795292 | A2 | 9/1997 |
| EP | 0943281 | A2 | 9/1999 |
| EP | 0943282 | A2 | 9/1999 |
| EP | 1040786 | A1 | 10/2000 |
| EP | 1040787 | A1 | 10/2000 |
| EP | 1252856 | A2 | 10/2002 |
| EP | 1277430 | A1 | 1/2003 |
| EP | 1334687 | A1 | 8/2003 |
| EP | 2292134 | A1 | 3/2011 |
| EP | 2572624 | A1 | 3/2013 |
| GB | 2019204 | A | 10/1979 |
| GB | 2199734 | A | 7/1988 |
| GB | 2215990 | A | 10/1989 |
| JP | 60053120 | | 3/1985 |
| JP | 4033632 | A | 2/1992 |
| JP | 5184514 | A | 7/1993 |
| JP | 8089467 | A | 4/1996 |
| JP | 9164107 | A | 6/1997 |
| JP | 10243910 | A | 9/1998 |
| JP | 11019019 | A | 1/1999 |
| JP | 11076127 | A | 3/1999 |
| JP | 2004113683 | A | 4/2004 |
| KR | 200156558 | Y1 | 9/1999 |
| KR | 20060029567 | A | 4/2006 |
| KR | 20090037299 | A | 4/2009 |
| WO | 2010012703 | A2 | 2/2010 |
| WO | 2011144540 | A2 | 11/2011 |
| WO | 2011154471 | A1 | 12/2011 |
| WO | 2012065873 | A2 | 5/2012 |

OTHER PUBLICATIONS

European Search Report for Corresponding EP 12185510.0, Dec. 19, 2012.

European Search Report for Corresponding EP 12185512.6, Dec. 6, 2012.

German Search Report for Counterpart DE102013111241.2, May 23, 2014.

European Search Report for Corresponding EP14177086.7, Oct. 20, 2014.

European Search Report for Corresponding EP14155441.0, May 30, 2014.

European Search Report for Corresponding EP14155444.4, May 6, 2014.

DISHWASHER WITH SPRAY SYSTEM

CROSS-REFERENCE TO RELATED APPLICATIONS

This application claims of the benefit of U.S. Provisional Patent Application No. 61/537,595, filed Sep. 22, 2011, which is incorporated herein by reference in its entirety.

BACKGROUND OF THE INVENTION

Contemporary automatic dishwashers for use in a typical household include a tub and at least one rack or basket for supporting soiled utensils within the tub. A spraying system may be provided for recirculating liquid throughout the tub to remove soils from the utensils. The spraying system may include various sprayers including a rotatable spray arm.

SUMMARY

An embodiment of the invention relates to a dishwasher having a tub at least partially defining a treating chamber, a rotatable spray arm defining an interior through which liquid may pass, first and second driving nozzles wherein emission of liquid from the first driving nozzle and not the second driving nozzle rotates the rotating arm in a first direction, and emission of liquid from the second driving nozzle and not the first driving nozzle rotates the rotating arm in a second direction, opposite the first direction, a movable element located within the interior and movable between a first position, where the first driving nozzle is open and the second driving nozzle is closed, and a second position, where the first driving nozzle is closed and the second driving nozzle is open, and a reciprocating element operably coupled between the movable element and the rotatable spray arm for reciprocation within the interior to alternately switch the movable element between the first and second positions to reverse the direction of rotation of the rotatable spray arm.

DESCRIPTION OF EMBODIMENTS OF THE INVENTION

Figure 1:
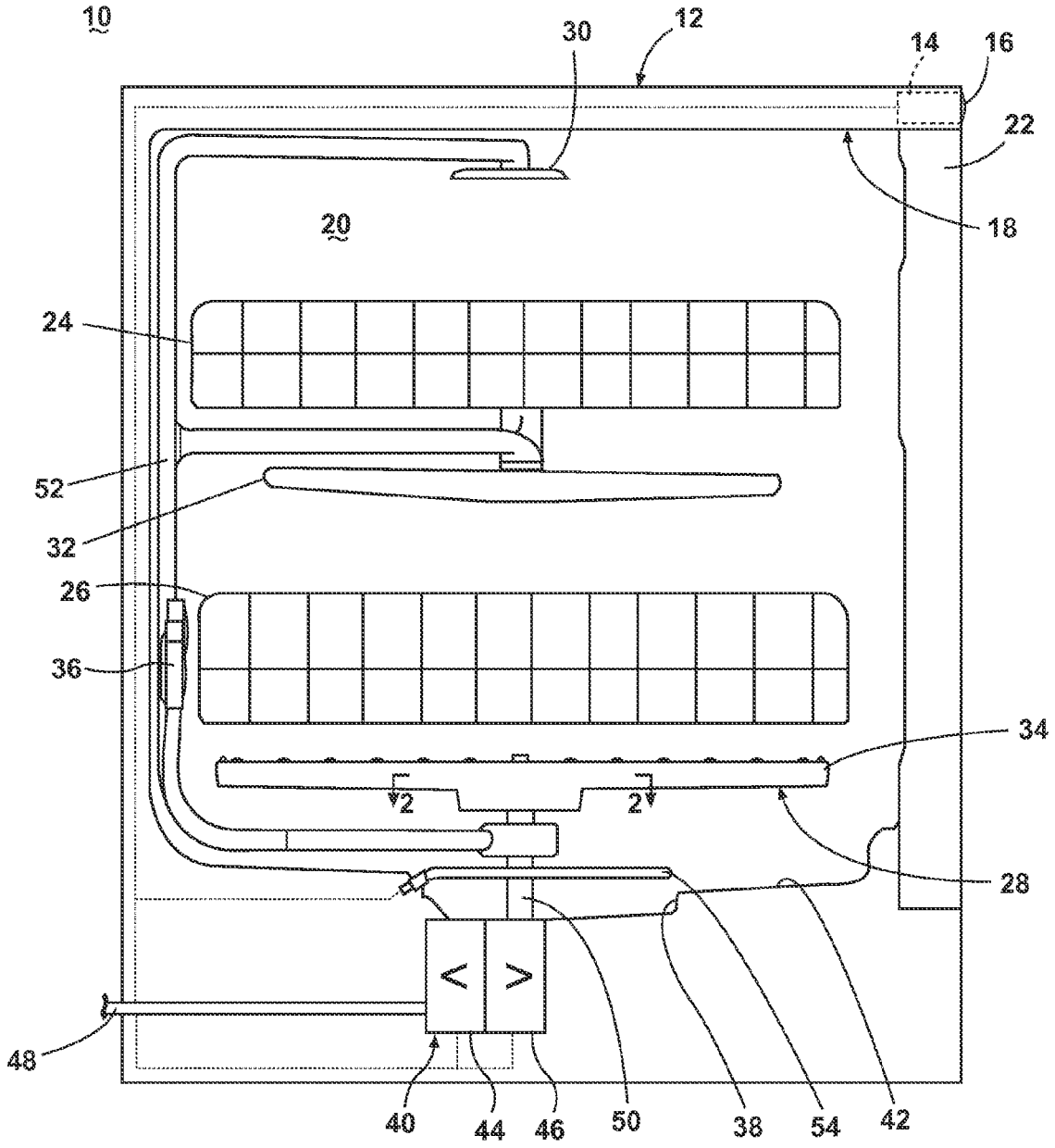
FIG. 1 is a schematic view of a dishwasher with a spray system according to a first embodiment of the invention.

Referring to FIG. 1, a first embodiment of the invention is illustrated as an automatic dishwasher 10 having a cabinet 12 defining an interior. Depending on whether the dishwasher 10 is a stand-alone or built-in, the cabinet 12 may be a chassis/ frame with or without panels attached, respectively. The dishwasher 10 shares many features of a conventional automatic dishwasher, which will not be described in detail herein except as necessary for a complete understanding of the invention. While the present invention is described in terms of a conventional dishwashing unit, it could also be implemented in other types of dishwashing units, such as in-sink dishwashers, multi-tub dishwashers, or drawer-type dishwashers.

A controller 14 may be located within the cabinet 12 and may be operably coupled with various components of the dishwasher 10 to implement one or more cycles of operation. A control panel or user interface 16 may be provided on the dishwasher 10 and coupled with the controller 14. The user interface 16 may include operational controls such as dials, lights, switches, and displays enabling a user to input commands, such as a cycle of operation, to the controller 14 and receive information.

A tub 18 is located within the cabinet 12 and at least partially defines a treating chamber 20 with an access opening in the form of an open face. A cover, illustrated as a door 22, may be hingedly mounted to the cabinet 12 and may move between an opened position, wherein the user may access the treating chamber 20, and a closed position, as shown in FIG. 1, wherein the door 22 covers or closes the open face of the treating chamber 20.

Utensil holders in the form of upper and lower racks 24, 26 are located within the treating chamber 20 and receive utensils for being treated. The racks 24, 26 are mounted for slidable movement in and out of the treating chamber 20 for ease of loading and unloading. As used in this description, the term "utensil(s)" is intended to be generic to any item, single or plural, that may be treated in the dishwasher 10, including, without limitation; dishes, plates, pots, bowls, pans, glassware, and silverware. While not shown, additional utensil holders, such as a silverware basket on the interior of the door 22, may also be provided.

A spraying system 28 may be provided for spraying liquid into the treating chamber 20 and is illustrated in the form of an upper sprayer 30, a mid-level rotatable sprayer 32, a lower rotatable spray arm 34, and a spray manifold 36. The upper sprayer 30 may be located above the upper rack 24 and is illustrated as a fixed spray nozzle that sprays liquid downwardly within the treating chamber 20. Mid-level rotatable sprayer 32 and lower rotatable spray arm 34 are located, respectively, beneath upper rack 24 and lower rack 26 and are illustrated as rotating spray arms. The mid-level spray arm 32 may provide a liquid spray upwardly through the bottom of the upper rack 24. The lower rotatable spray arm 34 may provide a liquid spray upwardly through the bottom of the lower rack 26. The mid-level rotatable sprayer 32 may optionally also provide a liquid spray downwardly onto the lower rack 26, but for purposes of simplification, this will not be illustrated herein.

The spray manifold 36 may be fixedly mounted to the tub 18 adjacent to the lower rack 26 and may provide a liquid spray laterally through a side of the lower rack 26. The spray manifold 36 may not be limited to this position; rather, the spray manifold 36 may be located in virtually any part of the treating chamber 20. While not illustrated herein, the spray manifold 36 may include multiple spray nozzles having apertures configured to spray wash liquid towards the lower rack 26. The spray nozzles may be fixed or rotatable with respect to the tub 18. Suitable spray manifolds are set forth in detail in U.S. Pat. No. 7,445,013, filed Jun. 17, 2003, and titled "Multiple Wash Zone Dishwasher," and U.S. Pat. No. 7,523,758, filed Dec. 30, 2004, and titled "Dishwasher Having Rotating Zone Wash Sprayer," both of which are incorporated herein by reference in their entirety.

A liquid recirculation system may be provided for recirculating liquid from the treating chamber 20 to the spraying system 28. The recirculation system may include a sump 38 and a pump assembly 40. The sump 38 collects the liquid sprayed in the treating chamber 20 and may be formed by a sloped or recessed portion of a bottom wall 42 of the tub 18. The pump assembly 40 may include both a drain pump 44 and a recirculation pump 46.

The drain pump 44 may draw liquid from the sump 38 and pump the liquid out of the dishwasher 10 to a household drain line 48. The recirculation pump 46 may draw liquid from the sump 38 and pump the liquid to the spraying system 28 to supply liquid into the treating chamber 20. While the pump assembly 40 is illustrated as having separate drain and recirculation pumps 44, 46 in an alternative embodiment, the pump assembly 40 may include a single pump configured to selectively supply wash liquid to either the spraying system 28 or the drain line 48, such as by configuring the pump to rotate in opposite directions, or by providing a suitable valve system. While not shown, a liquid supply system may include a water supply conduit coupled with a household water supply for supplying water to the sump 38.

As shown herein, the recirculation pump 46 has an outlet conduit 50 in fluid communication with the spraying system 28 for discharging wash liquid from the recirculation pump 46 to the sprayers 30-36. As illustrated, liquid may be supplied to the spray manifold 36, mid-level rotatable sprayer 32, and upper sprayer 30 through a supply tube 52 that extends generally rearward from the recirculation pump 46 and upwardly along a rear wall of the tub 18. While the supply tube 52 ultimately supplies liquid to the spray manifold 36, mid-level rotatable sprayer 32, and upper sprayer 30, it may fluidly communicate with one or more manifold tubes that directly transport liquid to the spray manifold 36, mid-level rotatable sprayer 32, and upper sprayer 30. Further, diverters (not shown) may be provided within the spraying system 28 such that liquid may be selectively supplied to each of the sprayers 30-36. The sprayers 30-36 spray water and/or treating chemistry onto the dish racks 24, 26 (and hence any utensils positioned thereon) to effect a recirculation of the liquid from the treating chamber 20 to the liquid spraying system 28 to define a recirculation flow path.

A heating system having a heater 54 may be located within or near the sump 38 for heating liquid contained in the sump 38. A filtering system (not shown) may be fluidly coupled with the recirculation flow path for filtering the recirculated liquid.

Figure 2:
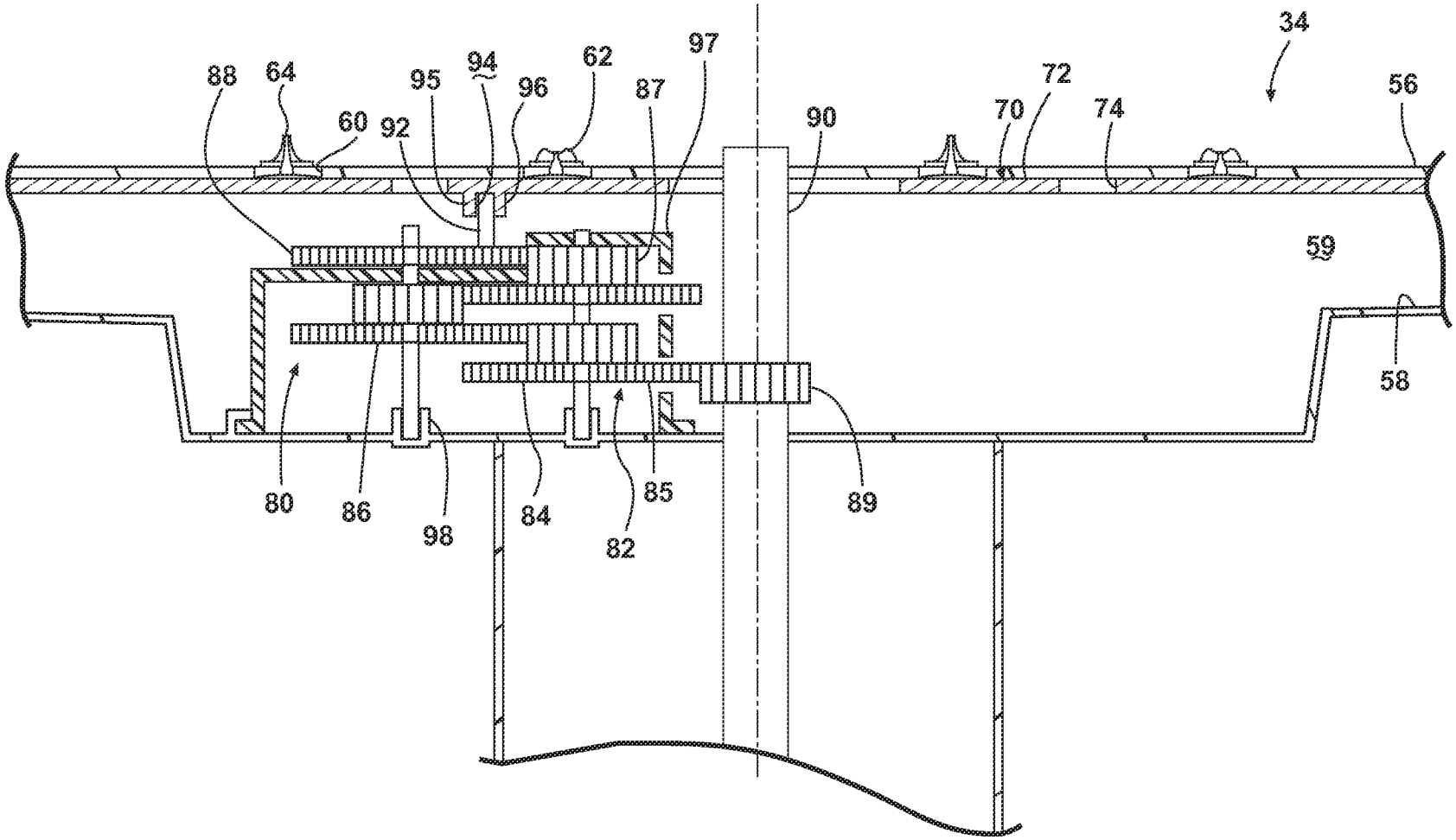
FIG. 2 is a cross-sectional view of a rotatable spray arm of the spray system of the dishwasher of FIG. 1 and illustrating a valve body for the rotatable spray arm.

FIG. 2 illustrates a cross-sectional view of the lower rotatable spray arm 34 comprising a body 56 having an interior 58. A liquid passage 59 may be provided in the interior 58 and fluidly couples with the outlet conduit 50 and recirculation pump 46. A plurality of outlets 60 extend through the body 56 and may be in fluid communication with the liquid passage 59. As illustrated, the interior 58 defines the liquid passage 59. However, a separate liquid passage 59 may be located within the interior 58.

Nozzles, such as nozzles 62 and 64, may be provided on the body 56 and may be fluidly coupled with the outlets 60, which lead to the liquid passage 59. Multiple nozzles 62 and 64 have been illustrated. The multiple nozzles 62 may correlate to a first subset of the plurality of outlets 60 and the multiple nozzles 64 may correlate to a second subset of the plurality of outlets 60. Nozzles 62 and 64 may provide different spray patterns, although this need not be the case. It is advantageous to do so to provide for different cleaning effects from a single spray arm. The first nozzle 62 may emit a first spray pattern (not shown), which may be a discrete, focused, and concentrated spray, which may provide a higher pressure spray. The second nozzle 64 may emit a second spray pattern (not shown), which may be a wide angle diffused spray pattern that produces more of a shower as compared to the more concentrated and discrete spray pattern produced by the first nozzle 62. The shower spray may be more suitable for distributing treating chemistry whereas the higher pressure spray may be more suitable for dislodging soils. It has been contemplated that the nozzles 62 and 64 may be arranged differently such that each type of nozzle 62, 64 may be included in both the first and second subsets of outlets 60.

A valve body 70 is illustrated as being located within the interior 56 and may be operable to selectively fluidly couple at least some of the plurality of outlets 60 to the liquid passage 59. The valve body 70 may be reciprocally movable within the body 56. More specifically, the valve body 70 has been illustrated as including a sliding plate 72 having multiple openings 74. The sliding plate 72 may be slidably mounted within the interior 58 of the body 56 of the rotatable spray arm 34 for movement between at least two positions. One position may allow the multiple openings 74 to fluidly couple the first subset of outlets 60 to the liquid passage 59 and the second position may allow the multiple openings 74 to fluidly couple the second subset of outlets 60 to the liquid passage 59. In this way, the different nozzles 62, 64 and/or different spray patterns may be selected with the sliding of the plate 72. Alternatively, the different subsets of outlets 60 may be located on different portions of the arms such that the selection of a particular subset of outlets 60 controls the location of the spray, regardless of whether the spray pattern is different. For example, one subset of outlets 60 may be located at the ends of the spray arm to direct liquid solely into the hard to reach areas of the treating chamber.

An actuator 80 may be operably coupled with the valve body 70 and may move the valve body 70 between the at least two positions based on the rotation of the rotatable spray arm 34. The actuator 80 may be any suitable mechanism capable of moving the valve body 70 between the at least two positions based on the rotation of the rotatable spray arm 34. By way of a non-limiting example, the actuator 80 may include a drive system 82 operably coupled with the rotatable spray arm 34 and the valve body 70 such that rotation of the spray arm 34 moves the valve body 70 between the at least two positions. The drive system 82 has been illustrated as including a gear assembly 84 operably coupling the rotatable spray arm 34 and the valve body 70 such that rotation of the rotatable spray arm 34 moves the gear assembly 84 which in turn moves the sliding plate 72 between the at least two positions. Thus, the gear assembly 84 helps convert the rotational motion of the spray arm 34 into sliding motion for the sliding plate 72. The gear assembly 84 has been illustrated as including a gear chain having a first gear 85, second gear 86, third gear 87, fourth gear 88, and a fixed gear 89. A fixed shaft 90 may extend through a portion of the body 56 such that the rotatable spray arm 34 is rotationally mounted on the fixed shaft 90. Further, the fixed gear 89 may be fixedly mounted on the fixed shaft 90.

The drive system 82 further comprises a pin 92 operably coupled with and extending from an upper portion of the fourth gear 88 and received within a channel 94 located in the valve body 70 to operably couple the gear assembly 84 with the sliding plate 72. The channel 94 may be a depression in a bottom portion of the sliding plate 72 or as illustrated may be formed between two opposing walls 95, 96 extending downwardly from the bottom of the sliding plate 72.

A bracket 97 may be located within the interior 58 and houses at least a portion of the gear assembly 84 to provide support for the gear assembly 84. Portions of the gear assembly 84 may also be held within supports 98 formed by the body 56 of the spray arm assembly 34.

The operation of the dishwasher 10 with the described spray arm structure will now be described. The user will initially select a cycle of operation via the user interface 16, with the cycle of operation being implemented by the controller 14 controlling various components of the dishwasher 10 to implement the selected cycle of operation in the treating chamber 20. Examples of cycles of operation include normal, light/china, heavy/pots and pans, and rinse only. The cycles of operation may include one or more of the following steps: a wash step, a rinse step, and a drying step. The wash step may further include a pre-wash step and a main wash step. The rinse step may also include multiple steps such as one or more additional rinsing steps performed in addition to a first rinsing. During such cycles, wash fluid, such as water and/or treating chemistry (i.e., water and/or detergents, enzymes, surfactants, and other cleaning or conditioning chemistry) passes from the recirculation pump 46 into the spraying system 28 and then exits the spraying system through the sprayers 30-36.

Figure 3A:
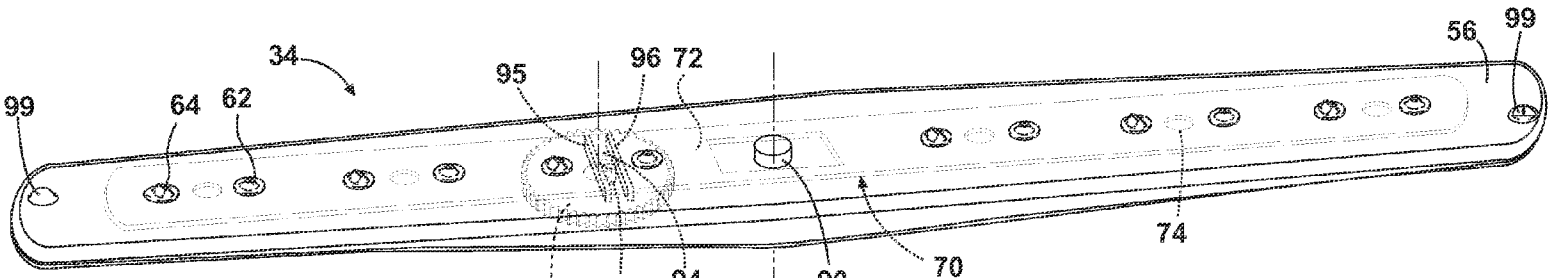
FIGS. 3A-3C are schematic views of the valve body in various positions within the rotatable spray arm of FIG. 2.

The lower rotatable spray arm 34 may rely on liquid pumped from the recirculation pump 46 to provide hydraulic drive to rotate the lower rotatable spray arm 34, which through the actuator 80 affects the movement of the valve body 70. More specifically, as illustrated in FIG. 3A, a hydraulic drive 99 may be formed by an outlet in the body 56 being oriented such that liquid emitted from the hydraulic drive outlet 99 effects the rotation of the lower rotatable spray arm 34. The lower rotatable spray arm 34 has been illustrated as having two hydraulic drive outlets 99 and these hydraulic drive outlets 99 are located such that when the recirculation pump 46 is activated, the lower rotatable spray arm 34 rotates regardless of the position of the valve body 70. It has also been contemplated that such hydraulic drive outlets 99 may be located on various portions of the body 56 including a side or bottom portion of the body 56. Alternatively, one or more of the multiple nozzles 62, 64 may form such hydraulic drive outlets.

As the lower rotatable spray arm 34 is hydraulically rotated about the fixed shaft 90, the first gear 85, which is mounted between the fixed gear 89 and the second gear 86, is rotatably mounted within the support 98, and moves with the rotation of the lower rotatable spray arm 34, may be driven around the fixed gear 89. Thus, the first gear 85 is also hydraulically driven and may be caused to circle about the fixed gear 89 as the lower rotatable spray arm 34 rotates about the fixed shaft 90. As the first gear 85 is driven about the fixed gear 89, it in turn causes the rotation of the second gear 86, the third gear 87, and the fourth gear 88.

Figure 3B:
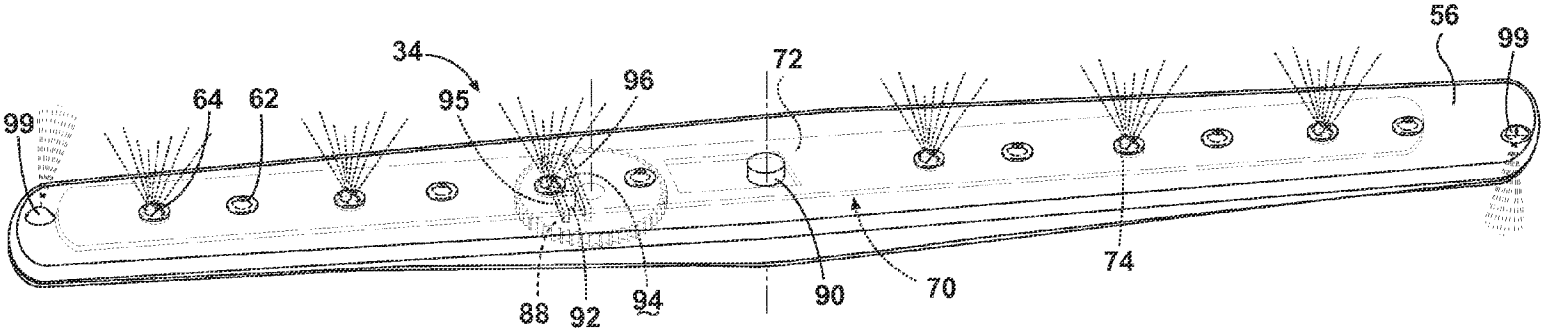
Figure 3C:
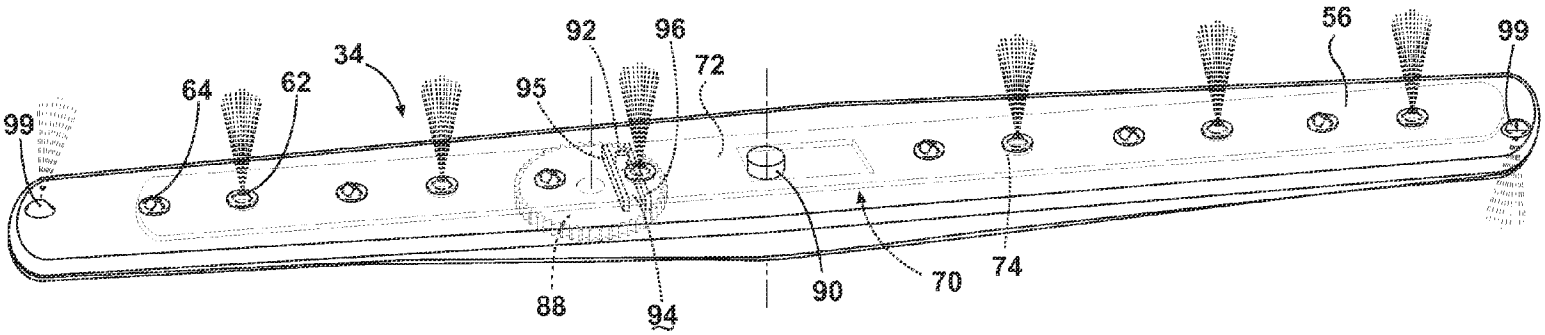

As the fourth gear 88 rotates, the pin 92 rotates within the interior 58 of the lower rotatable spray arm 34. As the pin 92 rotates, it moves within the boundaries of the channel 94 and causes the sliding plate 72 to be moved back and forth within the interior 58 of the lower rotatable spray arm 34. More specifically, as the pin 92 rotates with the fourth gear 88, the pin 92 pushes on the wall 95 for a first portion of a full rotation of the fourth gear 88 and pushes on the wall 96 for a second portion of the full rotation of the fourth gear 88. When the pin 92 pushes on the wall 95 it moves the sliding plate 72 to the first position illustrated in FIG. 3B. The sliding plate 72 may stay in the first position until the pin 92 is rotationally advanced to a point where it begins to push on the wall 96. When the pin 92 pushes on the wall 96 it moves the sliding plate 72 in the opposite direction until it reaches the second position illustrated in FIG. 3C. The sliding plate 72 may stay in the second position until the pin 92 is rotationally advanced to a point where it begins to again push on the wall 95. As the fourth gear 88 continues to rotate, the pin 92 continues to alternatively push against one of the walls 95 and 96 and continues to move the sliding plate 72 into the first and second positions. In this manner, the movement of the pin 92 within the channel 94 operably couples the gear assembly 84 to the sliding plate 72 such that the rotation of the gear assembly 84 may be converted into translational movement of the sliding plate 72. Essentially, the actuator 80 allows the valve body 70 to move between the at least two positions based on a rotational position of the rotatable spray arm 34.

As the sliding plate 72 moves side to side inside the lower rotatable spray arm 34, the valve body 70 closes the fluid path to one of the first and second subsets of outlets 60 and opens a fluid path to the other of the first and second subsets of outlets 60. More specifically, as the sliding plate 72 moves within the lower rotatable spray arm 34, the multiple openings 74 may align with either the first and second subset of outlets 60. When the sliding plate 72 is in the first position, the multiple openings 74 are aligned with the first subset of outlets 60 correlating to the multiple nozzles 62 and in the second position the multiple openings 74 are aligned with the second subset of outlets 60 correlating to the multiple nozzles 64. Thus, as the valve body 70 moves relative to the lower rotatable spray arm 34, each of the first and second subsets of outlets 60 are sequentially fluidly coupled and uncoupled as the lower rotatable spray arm 34 rotates.

It has been contemplated that the valve body 70 may have additional openings or alternative openings such that the second subset of the plurality of outlets which are fluidly coupled with the liquid passage may only differ from the first subset by one of the outlets. It has also been contemplated that when the valve body 70 is located intermediately of the first and second positions, water may be still be sprayed from the plurality of outlets 60 if at least a portion of the multiple openings fluidly couples a portion of the plurality of outlets 60. It has also been contemplated that the valve body 70 may be shaped such that there may be a point where the outlets in the valve body 70 do not allow for the fluid to enter any of the plurality of outlets 60 except for the hydraulic drive outlets 99.

The gear chain of the gear assembly 84 is illustrated as forming a reduction gear assembly. That is the valve body 70 is moved between the at least two positions by the actuator 80 over multiple rotations of the lower rotatable spray arm 34. As illustrated, the reduction gear assembly may provide a 40:1 gear reduction such that the valve body 70 will slide to the first and second positions over forty revolutions of the lower rotatable spray arm 34. The gear ratios of the gear assembly 84 may be selected to control the relative movement of the valve body 70 to the lower rotatable spray arm 34. The gear ratio of the gear assembly 84 is a function of the ratios of gears forming the gear assembly 84. Thus, the gears may be selected to provide a desired ratio to provide a desired fluid coupling time between the fluid passage 59 and the first and second subsets of outlets 60. The gear reduction ratio may also be selected to aid in allowing the hydraulic drive outlets 99 to overcome the friction created by the valve body 70.

As the rotatable spray arm 34 turns, the valve body 70 continues to move between the first and second positions and continues to selectively fluidly couple the first and second subsets of outlets 60. The amount of time that the multiple openings 74 are fluidly coupled with each of the first and second subsets of outlets 60 controls the duration of the time that each of the nozzles 62, 64 spray liquid. The time of fluid coupling may be thought of as a dwell time. With the above described valve body 70 and actuator 80, the dwell time may be controlled by the gear ratio, the spacing between the two opposing walls 95, 96 extending around the pin 92, and the flow rate of liquid. The movement of the lower rotatable spray arm 34 and the valve body 70 ends when fluid is no longer pumped by the recirculation pump 46 to the lower rotatable spray arm 34 such that the lower rotatable spray arm 34 is no longer hydraulically driven.

It has also been contemplated that a drive system may be included to control the rotation of the lower rotatable spray arm 34. Such a drive system may be motor-driven. For example, an electric motor (not shown) may be provided externally of the tub 18 and may be operably coupled to a portion of the lower rotatable spray arm 34 to rotate the lower rotatable spray arm 34. Such a motor-driven spray arm is set forth in detail in U.S. Pat. No. 8,113,222, filed Dec. 16, 2008, and titled "Dishwasher with Driven Spray Arm for Upper Rack" and U.S. Pat. No. 7,980,260, filed Apr. 16, 2010, and titled "Dishwasher with Driven Rotatable Spray Arm," which are incorporated herein by reference in their entirety. If the lower rotatable spray arm 34 is motor operated, the valve body 70 may be moved as the lower rotatable spray arm 34 rotates regardless of the flow rate provided by the recirculation pump 46. A motor driven lower rotatable spray arm 34 may be useful in instances where no hydraulic drive outlets are provided. Such a motor driven lower rotatable spray arm 34 may also allow for longer dwell times. In this manner, zonal washing, may be accomplished within the treating chamber 20 because the motor may have the ability to manipulate the speed of rotation of the lower rotatable spray arm 34 such that the controller 14 may control the spray emitted from the multiple nozzles 62 and 64 in pre-selected areas of the treating chamber 20.

Figure 4:
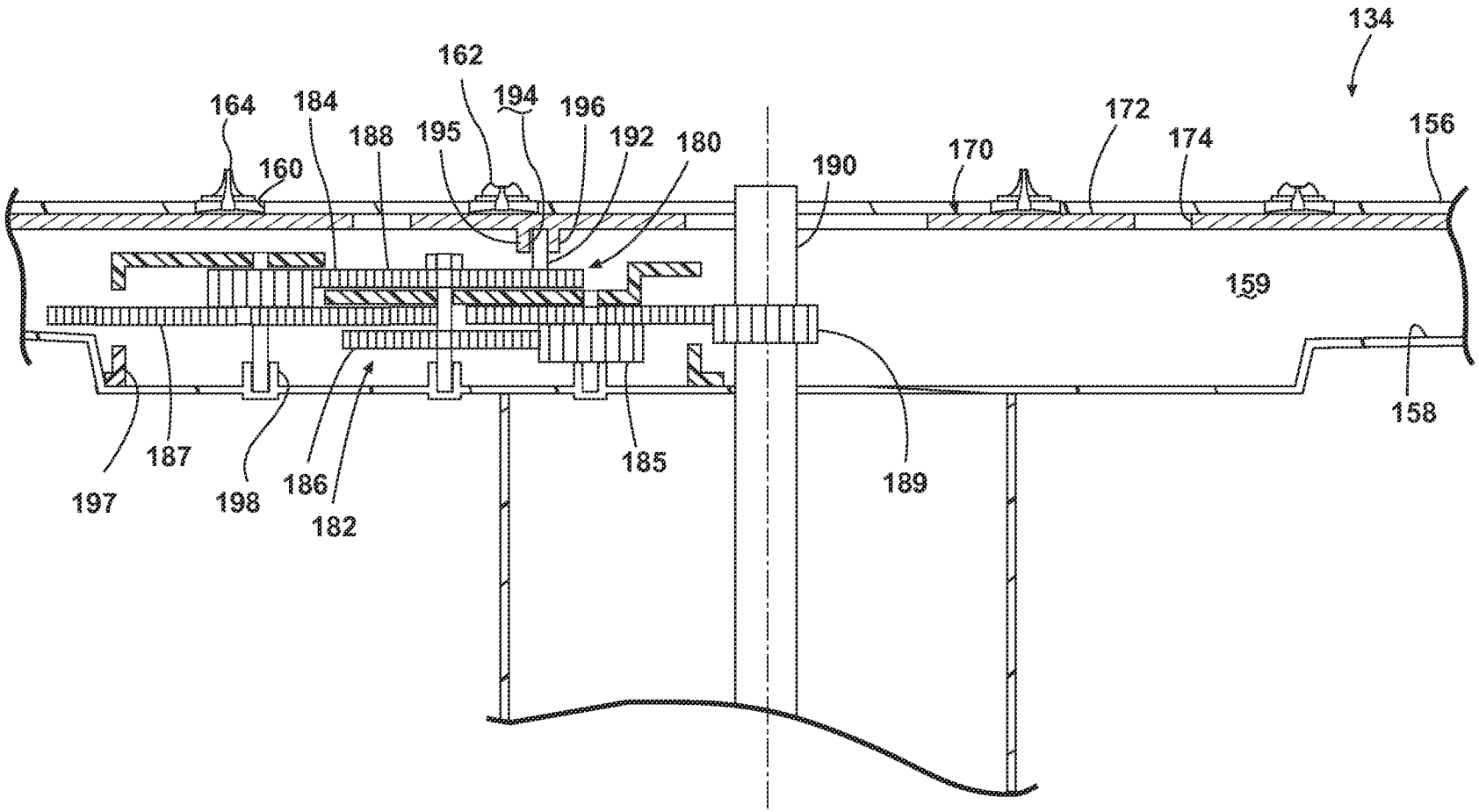
FIG. 4 is a cross-sectional view of a second embodiment of a lower spray arm, which may be used in the dishwasher of FIG. 1.

FIG. 4 illustrates a cross-sectional view of an alternative lower rotatable spray arm 134 according to a second embodiment of the invention. The lower rotatable spray arm 134 is similar to the lower rotatable spray arm 34 previously described and therefore, like parts will be identified with like numerals increased by 100, with it being understood that the description of the like parts of the lower rotatable spray arm 34 applies to the lower rotatable spray arm 134, unless otherwise noted.

The differences between the lower rotatable spray arm 34 and the lower rotatable spray arm 134 include that the lower rotatable spray arm 134 has been illustrated as having a lower profile body 156, an alternative gear assembly 184, and an alternative bracket 197, which is configured to accommodate the alternative gear assembly 184. During operation, the lower rotatable spray arm 134, valve body 170, and actuator 180 operate much the same as in the first embodiment wherein as the lower rotatable spray arm 134 is rotated, the gears in the gear assembly 184 are driven and the sliding plate 172 is moved between the first and second positions. However, the gear assembly 184 is configured to provide a larger gear reduction, namely a 73:1 gear reduction, such that the valve body 170 will slide to the first and second positions over 73 revolutions of the lower rotatable spray arm 134. Thus, the dwell time or fluid coupling time between the fluid passage 159 and the first and second subsets of outlets 160 is greater than in the first embodiment. Further, the lower profile body 156 may increase the space available in the treating chamber 20 for holding utensils to be treated.

Figure 5:
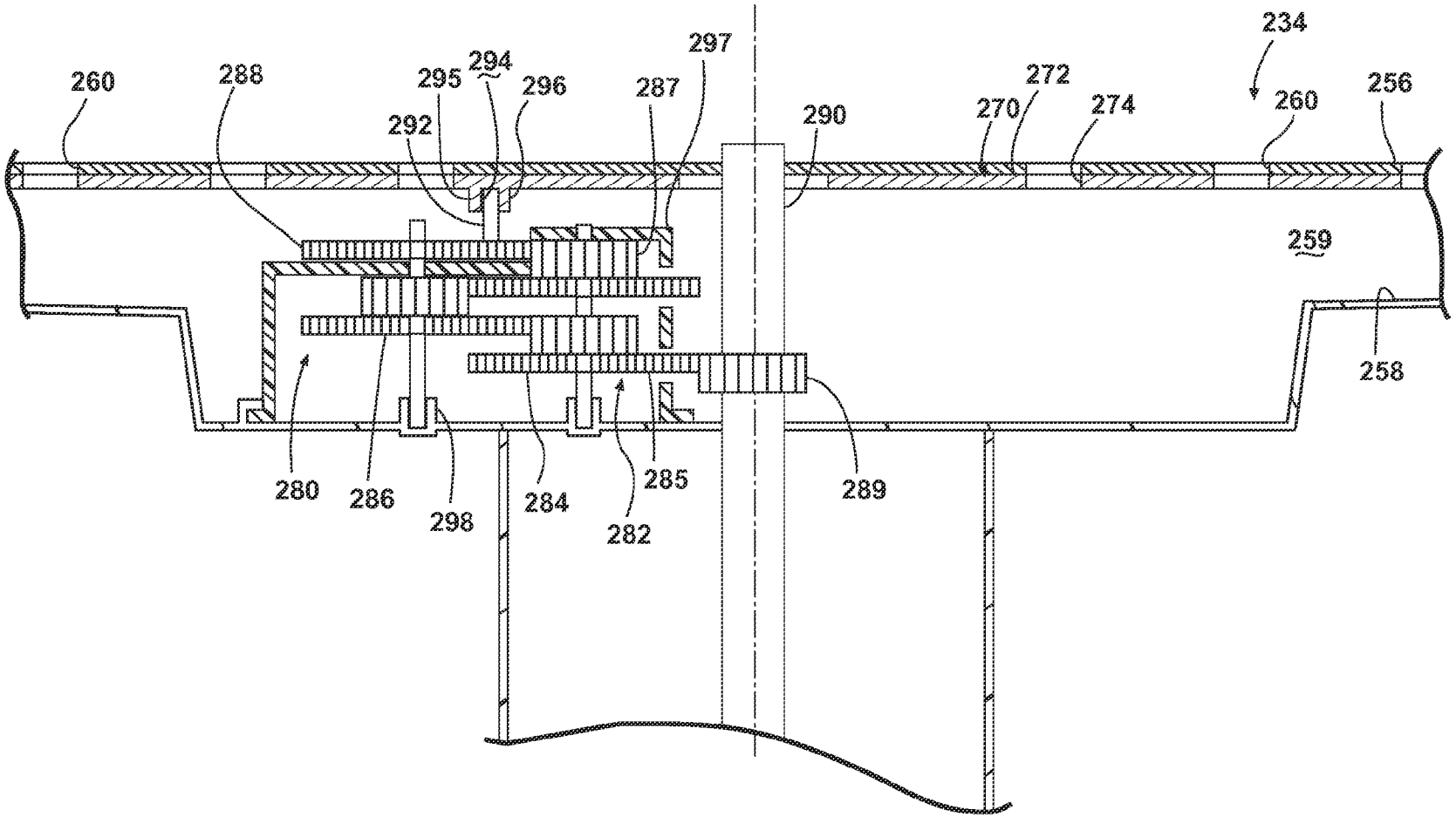
FIG. 5 is a cross-sectional view of a third embodiment of a lower spray arm, which may be used in the dishwasher of FIG. 1.

FIG. 5 illustrates a cross-sectional view of an alternative lower rotatable spray arm 234 according to a third embodiment of the invention. The lower rotatable spray arm 234 is similar to the lower rotatable spray arm 34 previously described and therefore, like parts will be identified with like numerals increased by 200, with it being understood that the description of the like parts of the lower rotatable spray arm 34 applies to the lower rotatable spray arm 234, unless otherwise noted.

One difference between the lower rotatable spray arm 34 and the lower rotatable spray arm 234 is that the plurality of outlets 260 form the nozzles for the spray arm 234 and no additional nozzle structures are provided on the body 256. Further, each of the outlets 260 is illustrated as having an identical configuration, such that there are no first and second subsets of outlets 260 as in the first embodiment. Alternatively however, the outlets 260 can be configured to provide different spray patterns, similar to the first embodiment. Another difference is that the sliding plate 272 of the valve body 270 has the same number of openings 274 as there are nozzle outlets 260. The sliding plate 272 may be slidably mounted within the interior 258 of the rotatable spray arm 234 for movement between at least two positions, and both positions may result in the multiple openings 274 being fluidly coupled with the multiple outlets 260. The valve body 270 may be formed such that the multiple openings 274 only partially close off a portion of the outlet 260 as the sliding plate 272 is moved between the first and second positions. In this manner, each paired outlet 260 and opening 274 may collectively form an effective opening or nozzle, and the sliding plate 272 may move to adjust the relative positions of the outlets 260 and opening 274 to alter the shape of the effective nozzle to control the shape of the spray and direction of liquid emitted from the outlet 260. During operation, the lower rotatable spray arm 234, valve body 270, and actuator 280 operate much the same as in the first embodiment wherein as the lower rotatable spray arm 234 is rotated, the gears in the gear assembly 284 are driven and the sliding plate 272 is moved between the first and second positions. Alternatively, the rotatable spray arm 234 can be provided with a gear assembly similar to that of the second embodiment to achieve a higher gear reduction and longer dwell time. As the sliding plate 272 is moved, the spray pattern from the outlets 260 is altered by the translation of the openings 274, which acts to change the flow of liquid from the outlet 260 by both reducing the size and changing the shape of the effective nozzle formed by the outlet 260 and opening 274. Such variations in the flow are set forth in detail in the application bearing Ser. No. 13/570361, filed concurrently herewith, and titled "Dishwasher with Spray System," which is incorporated herein by reference in its entirety.

Figure 6A:
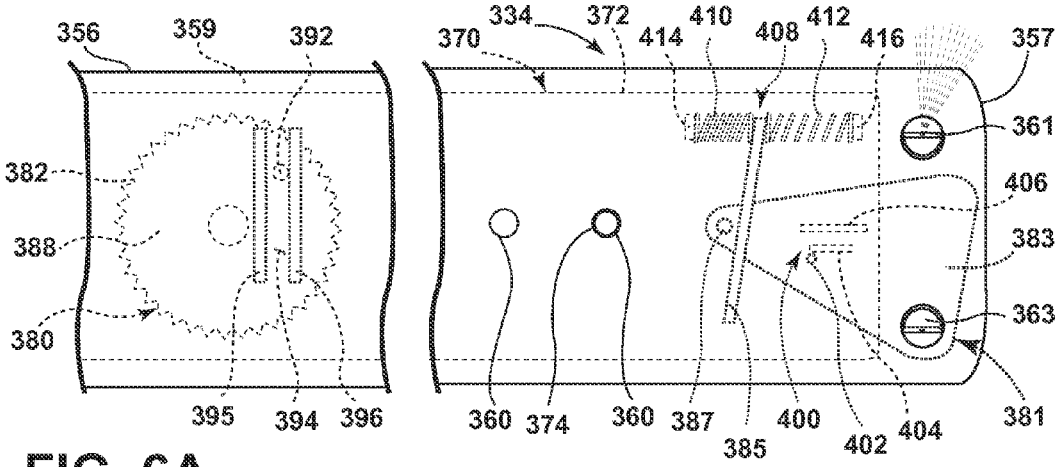
FIGS. 6A-6C are schematic top views of a movable element and reciprocating element in various positions within a rotatable spray arm according to a fourth embodiment, which may be used in the dishwasher of FIG. 1.
Figure 6B:
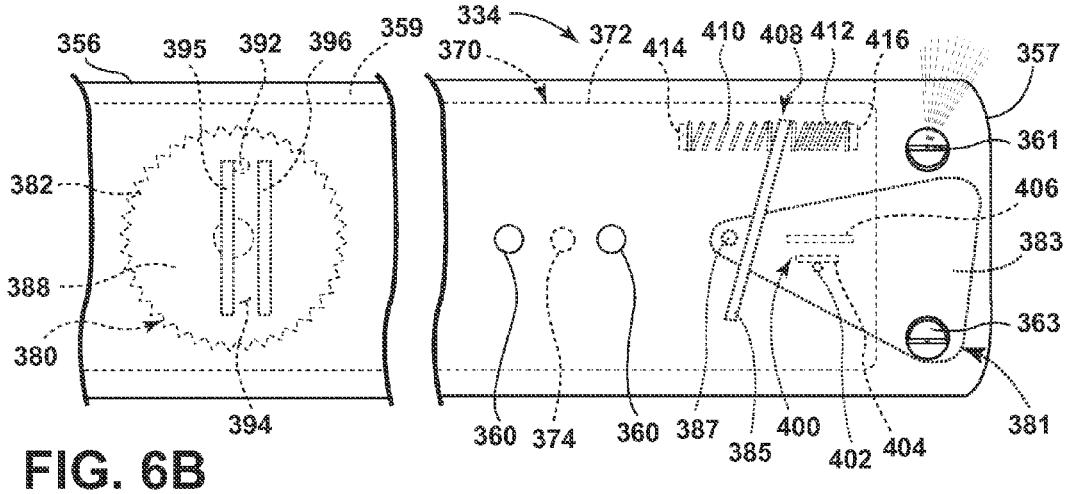
Figure 6C:
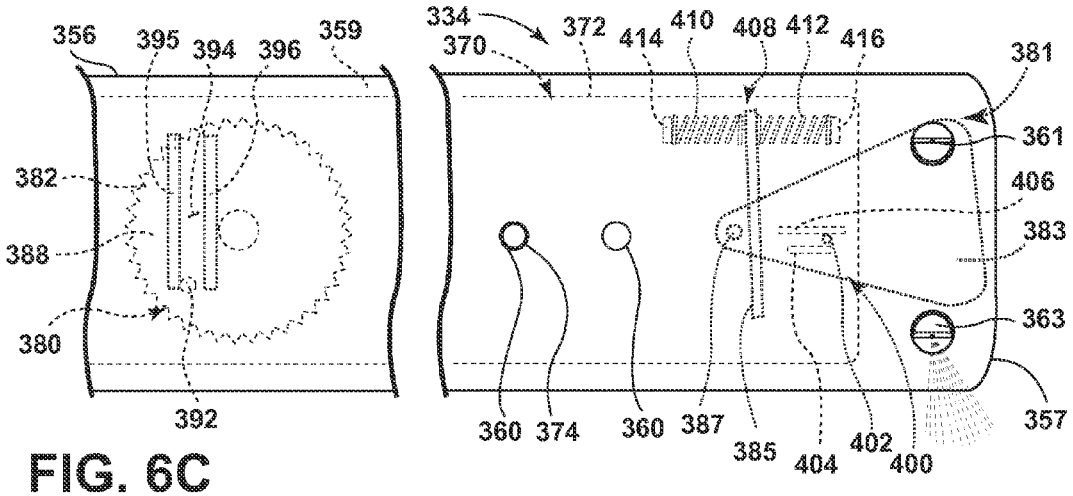

The above embodiments include a rotating spray arm that rotates in a single direction based on one or more hydraulic drives being oriented such that liquid emitted from the hydraulic drive outlet effects the rotation of the lower rotatable spray arm in the single direction. When the recirculation pump is activated, the lower rotatable spray arm rotates regardless of the position of the valve body. The fourth embodiment, as illustrated in FIGS. 6A-6C, utilizes an actuator such as the ones described in the embodiments above for sequencing driving nozzles to rotate the rotatable spray arm in both rotational directions. The lower rotatable spray arm 334, the actuator 380, and valve body 370 are similar to the lower rotatable spray arm 34, actuator 80, and valve body 70 previously described and therefore, like parts will be identified with like numerals increased by 300, with it being understood that the description of the like parts applies to the fourth embodiment, unless otherwise noted.

FIG. 6A illustrates a portion of an alternative lower rotatable spray arm 334 according to a fourth embodiment of the invention. As with previous embodiments, outlets 360 may be spaced in any variety of suitable manners along the lower rotatable spray arm 334. Each of the outlets 360 may be in fluid communication with a liquid passage 359 of the lower rotatable spray arm 334. More specifically, the outlets 360 may be fluidly coupled with the liquid passage 359 within the lower rotatable spray arm 334 through movement of the valve body 370 similar to the embodiments described above. Although not illustrated, each of the outlets 360 may have a corresponding nozzle provided on the body 356. The outlets 360 of the rotatable spray arm 334 and the openings 374 of the valve body 370 may be spaced and located in any suitable manner to create any variety of sprays, patterns, and pressures of sprays as the valve body 370 moves through its various positions and to increase or decrease the duration of the fluid communication between an opening 374 and an outlet 360.

One difference between the lower rotatable spray arm 34 and the lower rotatable spray arm 334 is that the lower rotatable spray arm 334 includes a first driving nozzle 361 and a second driving nozzle 363 on a first end 357 of the lower rotatable spray arm 334. The first and second driving nozzles 361 and 363 may be selectively in fluid communication with the liquid passage 359. The first driving nozzle 361 may be oriented such that liquid emitted from the first driving nozzle 361 effects the rotation of the lower rotatable spray arm 334. More specifically, emission of liquid from the first driving nozzle 361 and not the second driving nozzle 363 rotates the lower rotatable spray arm 334 in a first direction, which is a clockwise direction. The second driving nozzle 363 may be oriented such that liquid emitted from the second driving nozzle 363 effects the rotation of the lower rotatable spray arm 334 in a second direction, which is a counter-clockwise direction. More specifically, emission of liquid from the second driving nozzle 363 and not the first driving nozzle 361 rotates the lower rotatable spray arm 334 in a second direction, opposite the first direction.

In the illustrated example, the lower rotatable spray arm 334 includes a movable element 381 located within the interior and movable between a first position (FIG. 6A), where the first driving nozzle 361 is open and the second driving nozzle 363 is closed, and a second position (FIG. 6C), where the first driving nozzle 361 is closed and the second driving nozzle 363 is open. The movable element 381 is illustrated as including a switch plate 383 and an extension 385. The movable element 381 may be pivotally mounted, such as at the location 387, to the body 356 of the lower rotatable spray arm 334 such that it may pivot between the first and second positions.

A reciprocating element may be operably coupled between the movable element 381 and the lower rotatable spray arm 334 for reciprocation within the interior 258 to alternately switch the movable element 381 between the first and second positions to reverse the direction of rotation of the lower rotatable spray arm 334. In the illustrated example, the reciprocating element is the sliding plate 372.

A cam 400 may be provided on one of the movable element 381 and the sliding plate 372, and a complementary cam follower 402 may be provided on the other of the movable element 381 and the sliding plate 372. In the illustrated example, the cam follower 402 is provided on the movable element 381 while the cam 400 is provided on the sliding plate 372. The reciprocation of the sliding plate 372 causes the cam follower 402 to follow the cam 400 to move the movable element 381 between the first and second positions. The cam 400 and cam follower 402 may be formed in any suitable manner that allows the cam follower 402 to follow the cam 400 such that the movable element 381 moves to the first and second position. For example, the cam 400 may include a wall and the cam follower 402 may include a pin. Further, as illustrated, the cam 400 may include a first wall 404 and a second wall 406 spaced from the first wall 404. The first wall 404 me be a different length than the second wall 406 and has been illustrated as being shorter than the second wall 406.

A biasing element 408 is also included and biases the movable element 381 into each of the positions. For example, the biasing element 408 may bias the movable element 381 toward the second position when the movable element 381 is in the first position and biases the movable element 381 toward the first position when the movable element 381 is in the second position. The biasing element 408 may include any suitable biasing element including a single spring. In the illustrated example, the biasing element 408 includes a set of springs. More specifically, the biasing element 408 has been illustrated as including a first spring 410 and a second spring 412 located between a first wall 414 and a second wall 416 on the sliding plate 372.

A drive system 382 operably couples the lower rotatable spray arm 334 to the reciprocating element. The drive system 382 is configured to effect movement between the first and second positions at a predetermined interval. In this case, the drive system 382 includes the actuator 380 and the gear assembly 384 discussed with respect to the embodiments above. The predetermined interval is a function of the rotation of the lower rotatable spray arm 334 and in the described example the predetermined interval is 30 to 50 revolutions of the lower rotatable spray arm 334 before the movable element 381 switches between positions. In this manner, the lower rotatable spray arm 334 would be able to rotate 30-50 revolution in one direction and then change direction for 30-50 revolutions in the other direction.

FIG. 6A illustrates that the first driving nozzle 361 may be open to the liquid passage 359 of the rotatable spray arm 334 and the second driving nozzle 363 may be closed from the liquid passage 359 of the rotatable spray arm 334 when the exemplary sliding plate 372 and the movable element 381 are in a first position, FIG. 6B illustrates that the first driving nozzle 361 may be open to the liquid passage 359 of the rotatable spray arm 334 and the second driving nozzle 363 may be closed from the liquid passage 359 of the rotatable spray arm 334 when the exemplary sliding plate 372 and the movable element 381 are in an intermediate position, and FIG. 6C illustrates that the first driving nozzle 361 may be closed from the liquid passage 359 of the rotatable spray arm 334 and the second driving nozzle 363 may be open to the liquid passage 359 of the rotatable spray arm 334 when the exemplary sliding plate 372 and the movable element 381 are in a second position. During operation, the lower rotatable spray arm 334, sliding plate 372, and actuator 380 operate much the same as in the first embodiment wherein as the lower rotatable spray arm 334 is rotated, gears in the drive system 382 are driven and the sliding plate 372 is moved between the first, intermediate, and second positions. Alternatively, a gear assembly similar to that of the second embodiment may be used to achieve a higher gear reduction and longer dwell time. Further, still any suitable gear assembly or actuator may be used to move the sliding plate 372 and the movable element 381.

As the lower rotatable spray arm 334 is hydraulically rotated, the actuator 380 moves the sliding plate 372 between the at least two positions. By way of a non-limiting example, as the fourth gear 388 of the drive system 382 rotates, the pin 392 rotates within the interior of the lower rotatable spray arm 334. As the pin 392 rotates, it moves within the boundaries of the channel 394 and causes the sliding plate 372 to be moved back and forth within the interior 358 of the lower rotatable spray arm 334. More specifically, as the pin 392 rotates with the fourth gear 388, the pin 392 pushes on the wall 395 for a first portion of a full rotation of the fourth gear 388 and pushes on the wall 396 for a second portion of the full rotation of the fourth gear 388. When the pin 392 pushes on the wall 396 it moves the sliding plate 372 to the first position illustrated in FIG. 6A. The cam follower 402 follows the first wall 404 when the movable element 381 is in the first position and the biasing element 408 biases the movable element 381 toward the first wall 404 when the cam follower 402 follows the first wall 404.

When the pin 392 is rotationally advanced to a point where it begins to push on the wall 395, the sliding plate 372 begins to move towards the second position. When the pin 392 pushes on the wall 395 it moves the sliding plate 372 in the opposite direction. As the sliding plate 372 slides, the extension 385 compresses the second spring 412, which begins to build up a load and tries to drive the movable element 381 to the second position. However, the movable element 381 is still held in position by cam follower 402 running along the first wall 404. Referring now to FIG. 6B, the sliding plate 372 has moved enough to compress the second spring 412 sufficiently to have developed a large enough load to move the movable element 381 but the first wall 404 is still holding the cam follower 402 and thus the movable element 381 in position.

Referring now to FIG. 6C, with further movement of the sliding plate 372, the movable element 381 is shown right after the cam follower 402 of the movable element 381 clears the first wall 404 and the force from the compressed second spring 412 acts on the extension 385 to rotate the movable element 381 to the second position, opening the drive nozzle 363 and closing the drive nozzle 361. The sliding plate 372 will then be driven towards the first end 357 of the lower rotatable spray arm 334, which moves the cam follower 402 along the second wall 406. The sliding plate 372 will then be driven until the first spring 410 is compressed between the extension 385 and the first wall 414 and the first spring 410 has built up enough of a load to force the movable element 381 back to the first position, similar to the state of compression shown in FIG. 6A. The continued movement of the sliding plate 372 will ultimately drive the cam follower 402 beyond the end of the first wall 404, where the force of the compressed spring 410 will rotate the movable element 381 to the second position, opening the drive nozzle 361 while closing the drive nozzle 361, and the cam follower 402 will return to the position shown in FIG. 6A. The process is repeated as along as the lower rotatable spray arm 334 continues to rotate.

The system described could be used on both the upper and lower racks. While the above example has been described with respect to a valve body 370 that controls a liquid flow to outlets 360 it will be understood that the may be used solely to switch the direction of the rotatable spray arm. In an alternative embodiment, it is contemplated that the reciprocating element may be used solely to change the rotational direction of the lower rotatable spray arm 334 and need not be designed to control the flow of liquid to the outlets 360. Further, while only a first end 357 of the lower rotatable spray arm 334 has been illustrated as having the first and second driving nozzles 361 and 363 along with the movable element 381 it will be understood that similar structures may be located on the opposite end of the lower rotatable spray arm 334 and may be configured to work in tandem with those one the first end 357 of the lower rotatable spray arm 334 such that the lower rotatable spray arm 334 may be rotated in both rotational directions. It has also been contemplated that such first and second driving nozzles 361 and 363 may be located on various portions of the body 356 including a side or bottom portion of the body 356 and that the movable element 381 may be configured to alternately switch between first and second positions to reverse the direction of rotation of the rotatable spray arm 334.

There are several advantages of the present disclosure arising from the various features of the apparatuses described herein. For example, the embodiments described above allow for additional coverage of the treating chamber with multiple spray patterns. The first and second embodiments allow for multiple types of spray nozzles having multiple spray patterns, which may be used during a cycle of operation, which in turn may result in better cleaning of utensils within the treating chamber with no additional liquid consumption. Further, because the lower rotatable sprayers have multiple subsets of outlets and each multiple subset has a smaller total nozzle area than current spray arm designs, lower flow rates may be used and this may result in less liquid or water being required. This may increase the velocity of the spray emitted from each of the first and second subsets of nozzles while not sacrificing coverage or individual nozzle size. Further, with less liquid flow needed, a smaller recirculation pump having a smaller motor may also be used which may result in a cost and energy savings. The third embodiment described above allows for a single type of nozzle which emits varying spray patterns, including sprays in different directions and having different intensities, which may result in additional coverage of the treating chamber and better cleaning of utensils within the treating chamber with no additional liquid consumption. The fourth embodiment allows the sprayer to be hydraulically rotated in either direction through movement of the valve body. The spray coverage achieved by such an embodiment would be enhanced because nozzles would be hitting both side of items in the racks, which may result in additional coverage of the treating chamber and better cleaning of utensils within the treating chamber with no additional liquid consumption.

While the invention has been specifically described in connection with certain specific embodiments thereof, it is to be understood that this is by way of illustration and not of limitation. For example, it has been contemplated that the valve body and actuator may be located in other rotatable spray arms such as a mid-level rotatable spray arm. Further, other actuators may be used to control the movement of the valve body based on the rotation of the lower rotatable spray arm and the illustrated actuators including gear assemblies are merely exemplary. Further, although both gear assemblies illustrated include the same number of gears, it has been contemplated that the gear assembly may include any number of gears. Further, even though the gear assemblies are shown in a stacked configuration they could organized in a more horizontal layout. Further, while the valve body has been illustrated and described as moving in a linear motion it is contemplated that the valve body may alternatively be moved in an orbital motion. Such a motion could be created in a variety of ways including, by way of non-limiting example, replacing the pin described above with a pivot pin, which is mounted to the valve body slightly off center of the final gear, which would allow the plate to orbit. Alternatively, one end of the valve body may have a pin in a short longitudinal slot defining one end, while the other end orbits. As yet another non-limiting alternative, an additional gear may be added in the same plane as the fourth gear and may be of the same size and thus rotate at a synchronized speed with the fourth gear. A pin may be included on this additional gear and may orbit in unison with and retain a constant distance from the other pin. Since the valve plate is engaged to both pins the entire plate would be caused to orbit. With the valve body, or a portion of the valve body, capable of orbital motion the multiple openings may be dispersed in a two-dimension plane in a wider variety of ways such that the outlets could be changed when the valve body orbits. Further, the valve body could be made to orbit around the multiple openings to allow for sprays in all directions.

Further still, while the sprayer has been illustrated and described as a rotatable spray arm it will be understood that any suitable sprayer may be used. For example, a non-rotatable spray arm may be used and the actuator may move the valve body within the spray arm. Further, a sprayer having a different shape may be used and may be either rotatable or non-rotatable. Similarly, while the valve body has been described and illustrated as a sliding plate it is contemplated that the valve body may take any suitable form and that the sliding plate may take any suitable form. For example, the sliding plate may include a rigid plate, a flexible plate, or a thin film plate, which may be either flexible or rigid. Further, the valve body may include a movable element and at least a portion may conform to the shape of the sprayer. Such a conformable valve body is set forth in detail in the Ser. No. 13/570577, filed concurrently herewith, and titled "Dishwasher with Spray System," which is incorporated herein by reference in its entirety. Further, it will be understood that any features of the above described embodiments may be combined in any manner.

The patentable scope of the invention is defined by the claims, and may include other examples that occur to those skilled in the art. Reasonable variation and modification are possible within the scope of the forgoing disclosure and drawings without departing from the spirit of the invention which is defined in the appended claims.

What is claimed is:

1. A dishwasher for treating utensils according to an automatic cycle of operation, comprising:

a tub at least partially defining a treating chamber for receiving utensils for treatment according to the automatic cycle of operation;

a rotatable spray arm provided within the treating chamber and defining an interior through which liquid may pass;

first and second driving nozzles provided on the rotatable spray arm and in fluid communication with the interior, wherein emission of liquid from the first driving nozzle and not the second driving nozzle rotates the rotatable spray arm in a first direction, and emission of liquid from the second driving nozzle and not the first driving nozzle rotates the rotatable spray arm in a second direction, opposite the first direction;

a movable element located within the interior and movable between a first position, where the first driving nozzle is open and the second driving nozzle is closed, and a second position, where the first driving nozzle is closed and the second driving nozzle is open; and a reciprocating element operably coupled between the movable element and the rotatable spray arm for reciprocation within the interior, based on the rotation of the rotatable spray arm, to alternately switch the movable element between the first and second positions to reverse the direction of rotation of the rotatable spray arm.

2. The dishwasher of claim 1 wherein the movable element is pivotally mounted to the rotatable spray arm to pivot between the first and second positions.

3. The dishwasher of claim 2, further comprising a cam provided on one of the movable element and the reciprocating element, and a complementary cam follower provided on the other of the movable element and the reciprocating element, wherein the reciprocation of the reciprocating element causes the cam follower to follow the cam to move the movable element between the first and second positions.

4. The dishwasher of claim 3 wherein the cam comprises a wall and the cam follower comprises a pin.

5. The dishwasher of claim 4 wherein the cam further comprises first and second spaced walls with the cam follower following the first wall when the movable element is in the first position and following the second wall when the movable element is in the second position.

6. The dishwasher of claim 5 wherein the first spaced wall is a different length than the second spaced wall.

7. The dishwasher of claim 5, further comprising a biasing element that biases the movable element toward the first wall when the cam follower follows the first wall and biases the movable element toward the second wall when the cam follower follows the second wall.

8. The dishwasher of claim 1, further comprising a drive system operably coupling the rotatable spray arm to the reciprocating element.

9. The dishwasher of claim 8 wherein the drive system is configured to effect movement between the first and second positions at a predetermined interval.

10. The dishwasher of claim 9 wherein the predetermined interval is a function of the rotation of the rotatable spray arm.

11. The dishwasher of claim 10 wherein the predetermined interval is 30 to 50 revolutions of the rotatable spray arm.

12. The dishwasher of claim 2 wherein the reciprocating element is a laterally reciprocating element.

13. A dishwasher for treating utensils according to an automatic cycle of operation, comprising:

a tub at least partially defining a treating chamber for receiving utensils for treatment according to the automatic cycle of operation;

a rotatable spray arm provided within the treating chamber and defining an interior through which liquid may pass;

first and second driving nozzles provided on the rotatable spray arm and in fluid communication with the interior, wherein emission of liquid from the first driving nozzle and not the second driving nozzle rotates the rotatable spray arm in a first direction, and emission of liquid from the second driving nozzle and not the first driving nozzle rotates the rotatable spray arm in a second direction, opposite the first direction;

a movable element located within the interior and movable between a first position, where the first driving nozzle is open and the second driving nozzle is closed, and a second position, where the first driving nozzle is closed and the second driving nozzle is open;

a reciprocating element operably coupled between the movable element and the rotatable spray arm for reciprocation within the interior to alternately switch the movable element between the first and second positions to reverse the direction of rotation of the rotatable spray arm; and a cam provided on one of the movable element and the reciprocating element, and a complementary cam follower provided on the other of the movable element and the reciprocating element, wherein the reciprocation of the reciprocating element causes the cam follower to follow the cam to move the movable element between the first and second positions.

14. The dishwasher of claim 13, further comprising a biasing element that biases the movable element toward the second position when the movable element is in the first position and biases the movable element toward the first position when the movable element is in the second position.

15. The dishwasher of claim 13 wherein the reciprocating element is a laterally reciprocating element.

16. A dishwasher for treating utensils according to an automatic cycle of operation, comprising:

a tub at least partially defining a treating chamber for receiving utensils for treatment according to the automatic cycle of operation;

a rotatable spray arm provided within the treating chamber and defining an interior through which liquid may pass;

first and second driving nozzles provided on the rotatable spray arm and in fluid communication with the interior, wherein emission of liquid from the first driving nozzle and not the second driving nozzle rotates the rotatable spray arm in a first direction, and emission of liquid from the second driving nozzle and not the first driving nozzle rotates the rotatable spray arm in a second direction, opposite the first direction;

a movable element located within the interior and movable between a first position, where the first driving nozzle is open and the second driving nozzle is closed, and a second position, where the first driving nozzle is closed and the second driving nozzle is open; and a laterally reciprocating element operably coupled between the movable element and the rotatable spray arm for reciprocation within the interior to alternately switch the movable element between the first and second positions to reverse the direction of rotation of the rotatable spray arm.

* * * * *